US006640209B1

(12) United States Patent
Das

(10) Patent No.: US 6,640,209 B1
(45) Date of Patent: Oct. 28, 2003

(54) CLOSED-LOOP MULTIMODE MIXED-DOMAIN LINEAR PREDICTION (MDLP) SPEECH CODER

(75) Inventor: Amitava Das, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/259,151

(22) Filed: Feb. 26, 1999

(51) Int. Cl.[7] ..... G10L 19/04
(52) U.S. Cl. ..... 704/219; 704/207; 704/208
(58) Field of Search ..... 704/219, 205, 704/207, 208, 211, 214

(56) References Cited

U.S. PATENT DOCUMENTS

| | | | | | |
|---|---|---|---|---|---|
| 5,787,387 | A | * | 7/1998 | Aguilar | 704/208 |
| 5,808,569 | A | * | 9/1998 | Wuppermann et al. | 341/50 |
| 6,014,622 | A | * | 1/2000 | Su et al. | 704/223 |
| 6,223,151 | B1 | * | 4/2001 | Kleijn et al. | 704/207 |
| 6,236,961 | B1 | * | 5/2001 | Ozawa | 704/221 |

FOREIGN PATENT DOCUMENTS

| | | |
|---|---|---|
| EP | 0932141 | 7/1999 |
| WO | 9910719 | 3/1999 |

OTHER PUBLICATIONS

Amitava Das, et al., "*Multimode Variable bit Rate Speech Coding: an Efficient Paradigm for High–Quality Low–Rate Representation of Speech Signal*," IEEE International Conference on Acoustics, Speech, and Signal Processing, New York, NY, USA. May 5, 1999 (pp. 2307–2310).

Juan Carlos De Martin, et al., "*Mixed–Domain Coding of Speech at 3KB/S*," IEEE International Conference on Acoustics, Speech, and Signal Processing, Atlanta, Georgia, USA. May 7–10, 1996, vol. 1, (pp. 216–219).

Luca Cellario, et al., "*CELP Coding at Variable Rate*," European Transactions on Telecommunications and Related Technologies, IT, AEI, Milano. Sep. 1, 1994, vol. 5, No. 5 (pp. 603–613).

* cited by examiner

*Primary Examiner*—Doris H. To
*Assistant Examiner*—Michael N. Opsasnick
(74) *Attorney, Agent, or Firm*—Philip Wadsworth; Charles D. Brown; Kyong H. Macek

(57) ABSTRACT

A closed-loop, multimode, mixed-domain linear prediction (MDLP) speech coder includes a high-rate, time-domain coding mode, a low-rate, frequency-domain coding mode, and a closed-loop mode-selection mechanism for selecting a coding mode for the coder based upon the speech content of frames input to the coder. Transition speech (i.e., from unvoiced speech to voiced speech, or vice versa) frames are encoded with the high-rate, time-domain coding mode, which may be a CELP coding mode. Voiced speech frames are encoded with the low-rate, frequency-domain coding mode, which may be a harmonic coding mode. Phase parameters are not encoded by the frequency-domain coding mode, and are instead modeled in accordance with, e.g., a quadratic phase model. For each speech frame encoded with the frequency-domain coding mode, the initial phase value is taken to be the initial phase value of the immediately preceding speech frame encoded with the frequency-domain coding mode. If the immediately preceding speech frame was encoded with the time-domain coding mode, the initial phase value of the current speech frame is computed from the decoded speech frame information of the immediately preceding, time-domain-encoded speech frame. Each speech frame encoded with the frequency-domain coding mode may be compared with the corresponding input speech frame to obtain a performance measure. If the performance measure falls below a predefined threshold value, the input speech frame is encoded with the time-domain coding mode.

9 Claims, 11 Drawing Sheets

CLOSED-LOOP MULTIMODE MIXED-DOMAIN LINEAR PREDICTION (MDLP) SPEECH CODER

BACKGROUND OF THE INVENTION

I. Field of the Invention

The present invention pertains generally to the field of speech processing, and more specifically to a method and apparatus for closed-loop, multimode, mixed-domain coding of speech.

II. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Speech coders may be implemented as time-domain coders, which attempt to capture the time-domain speech waveform by employing high time-resolution processing to encode small segments of speech (typically 5 millisecond (ms) subframes) at a time. For each subframe, a high-precision representative from a codebook space is found by means of various search algorithms known in the art. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques described in A. Gersho & R. M. Gray, *Vector Quantization and Signal Compression* (1992).

A well-known time-domain speech coder is the Code Excited Linear Predictive (CELP) coder described in L. B. Rabiner & R. W. Schafer, *Digital Processing of Speech Signals* 396–453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding of the LP short-term filter coefficients and encoding the LP residue. Time-domain coding can be performed at a fixed rate (i.e., using the same number of bits, $N_0$, for each frame) or at a variable rate (in which different bit rates are used for different types of frame contents). Variable-rate coders attempt to use only the amount of bits needed to encode the codec parameters to a level adequate to obtain a target quality. An exemplary variable rate CELP coder is described in U.S. Pat. No. 5,414,796, which is assigned to the assignee of the present invention and fully incorporated herein by reference.

Time-domain coders such as the CELP coder typically rely upon a high number of bits, $N_0$, per frame to preserve the accuracy of the time-domain speech waveform. Such coders typically deliver excellent voice quality provided the number of bits, $N_0$, per frame relatively large (e.g., 8 kbps or above). However, at low bit rates (4 kbps and below), time-domain coders fail to retain high quality and robust performance due to the limited number of available bits. At low bit rates, the limited codebook space clips the waveform-matching capability of conventional time-domain coders, which are so successfully deployed in higher-rate commercial applications.

There is presently a surge of research interest and strong commercial needs to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall bit-budget of coder specifications and deliver a robust performance under channel error conditions.

For coding at lower bit rates, various methods of spectral, or frequency-domain, coding of speech have been developed, in which the speech signal is analyzed as a time-varying evolution of spectra. See, e.g., R. J. McAulay & T. F. Quatieri, *Sinusoidal Coding, in Speech Coding and Synthesis* ch. 4 (W. B. Kleijn & K.K. Paliwal eds., 1995). In spectral coders, the objective is to model, or predict, the short-term speech spectrum of each input frame of speech with a set of spectral parameters, rather than to precisely mimic the time-varying speech waveform. The spectral parameters are then encoded and an output frame of speech is created with the decoded parameters. The resulting synthesized speech does not match the original input speech waveform, but offers similar perceived quality. Examples of frequency-domain coders that are well known in the art include multiband excitation coders (MBEs), sinusoidal transform coders (STCs), and harmonic coders (HCs). Such frequency-domain coders offer a high-quality parametric model having a compact set of parameters that can be accurately quantized with the low number of bits available at low bit rates.

Nevertheless, low-bit-rate coding imposes the critical constraint of a limited coding resolution, or a limited codebook space, which limits the effectiveness of a single coding mechanism, rendering the coder unable to represent various types of speech segments under various background conditions with equal accuracy. For example, conventional low-bit-rate, frequency-domain coders do not transmit phase information for speech frames. Instead, the phase information is reconstructed by using a random, artificially generated, initial phase value and linear interpolation techniques. See, e.g., H. Yang et al., *Quadratic Phase Interpolation for Voiced Speech Synthesis in the MBE Model, in* 29 *Electronic Letters* 856–57 (May 1993). Because the phase information is artificially generated, even if the amplitudes of the sinusoids are perfectly preserved by the quantization-unquantization process, the output speech produced by the frequency-domain coder will not be aligned with the original input speech (i.e., the major pulses will not be in sync). It has therefore proven difficult to adopt any closed-loop performance measure, such as, e.g., signal-to-noise ratio (SNR) or perceptual SNR, in frequency-domain coders.

Multimode coding techniques have been employed to perform low-rate speech coding in conjunction with an open-loop mode decision process. One such multimode coding technique is described in Amitava Das et al., *Multimode and Variable-Rate Coding of Speech, in Speech Coding and Synthesis* ch. 7 (W. B. Kleijn & K.K. Paliwal eds., 1995). Conventional multimode coders apply different modes, or encoding-decoding algorithms, to different types of input speech frames. Each mode, or encoding-decoding process, is customized to represent a certain type of speech segment, such as, e.g., voiced speech, unvoiced speech, or background noise (nonspeech) in the most efficient manner. An external, open-loop mode decision mechanism examines the input speech frame and makes a decision regarding which mode to apply to the frame. The open-loop mode decision is typically performed by extracting a number of parameters from the input frame, evaluating the parameters as to certain temporal and spectral characteristics, and basing a mode decision upon the evaluation. The mode decision is thus made without knowing in advance the exact condition of the output speech, i.e., how close the output speech will be to the input speech in terms of voice quality or other performance measures.

Based on the foregoing, it would be desirable to provide a low-bit-rate, frequency-domain coder that more precisely estimates phase information. It would further be advantageous to provide a multimode, mixed-domain coder to time-domain encode certain speech frames and frequency-domain encode other speech frames based upon the speech content of the frames. It would still further be desirable to provide a mixed-domain coder that can time-domain encode certain speech frames and frequency-domain encode other speech frames in accordance with a closed-loop coding mode decision mechanism. Thus, there is a need for a closed-loop, multimode, mixed-domain speech coder that ensures time-synchrony between the output speech produced by the coder and the original speech input to the coder.

SUMMARY OF THE INVENTION

The present invention is directed to a closed-loop, multimode, mixed-domain speech coder that ensures time-synchrony between the output speech produced by the coder and the original speech input to the coder. Accordingly, in one aspect of the invention, a multimode, mixed-domain, speech processor advantageously includes a coder having at least one time-domain coding mode and at least one frequency-domain coding mode; and a closed-loop mode-selection device coupled to the coder and configured to select a coding mode for the coder based upon contents of frames processed by the speech processor.

In another aspect of the invention, a method of processing frames advantageously includes the steps of applying an open-loop coding mode selection process to each successive input frame to select either a time-domain coding mode or a frequency-domain coding mode based upon speech content of the input frame; frequency-domain coding the input frame if the speech content of the input frame indicates steady state voiced speech; time-domain coding the input frame if the speech content of the input frame indicates anything other than steady state voiced speech; comparing the frequency-domain-coded frame with the input frame to obtain a performance measure; and time-domain coding the input frame if the performance measure falls below a predefined threshold value.

In another aspect of the invention, a multimode, mixed-domain, speech processor advantageously includes means for applying an open-loop coding mode selection process to an input frame to select either a time-domain coding mode or a frequency-domain coding mode based upon speech content of the input frame; means for frequency-domain coding the input frame if the speech content of the input frame indicates steady state voiced speech; means for time-domain coding the input frame if the speech content of the input frame indicates anything other than steady state voiced speech; means for comparing the frequency-domain-coded frame with the input frame to obtain a performance measure; and means for time-domain coding the input frame if the performance measure falls below a predefined threshold value.

DETAILED DESCRIPTION OF THE PREFERRED EMBODIMENTS

Figure 1:
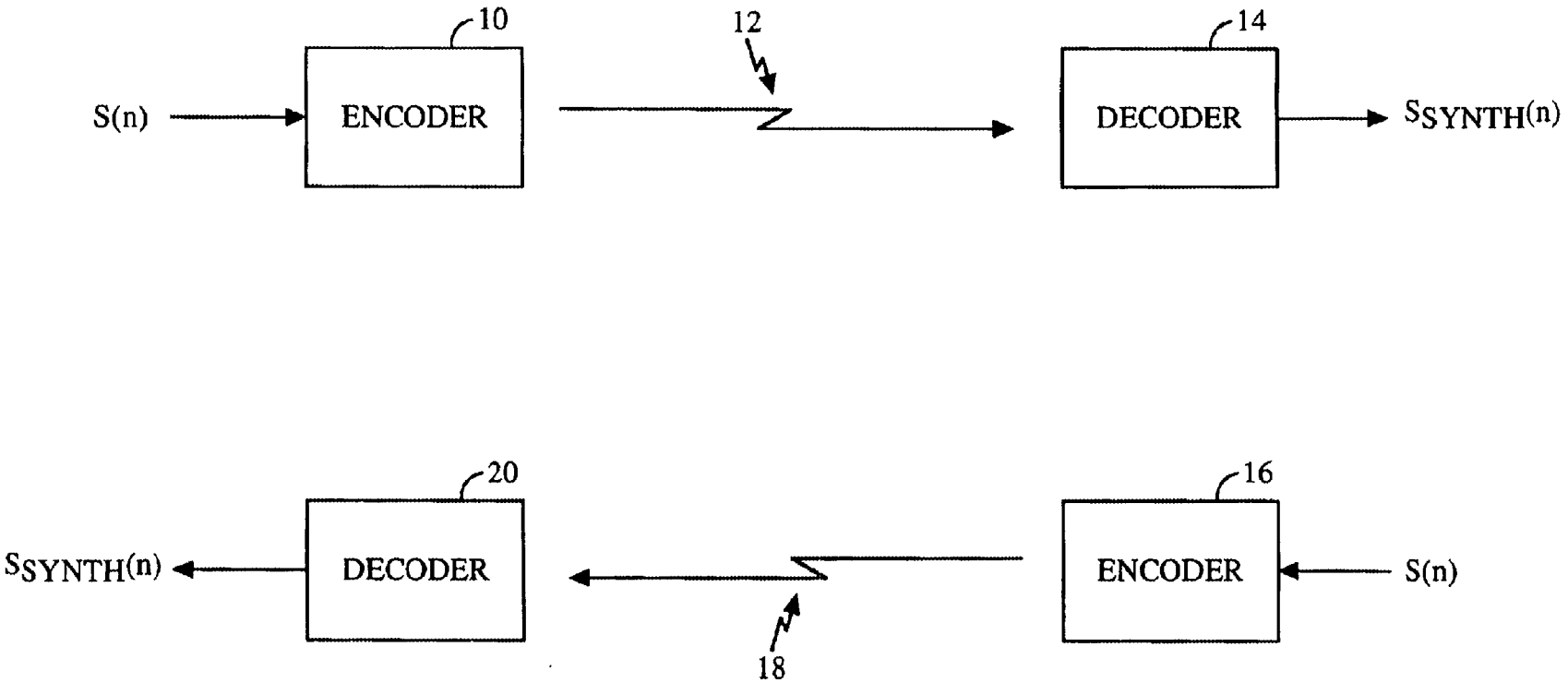
FIG. 1 is a block diagram of a communication channel terminated at each end by speech coders.

In FIG. 1 a first encoder 10 receives digitized speech samples s(n) and encodes the samples s(n) for transmission on a transmission medium 12, or communication channel 12, to a first decoder 14. The decoder 14 decodes the encoded speech samples and synthesizes an output speech signal $s_{SYNTH}(n)$. For transmission in the opposite direction, a second encoder 16 encodes digitized speech samples s(n), which are transmitted on a communication channel 18. A second decoder 20 receives and decodes the encoded speech samples, generating a synthesized output speech signal $s_{SYNTH}(n)$.

The speech samples s(n) represent speech signals that have been digitized and quantized in accordance with any of various methods known in the art including, e.g., pulse code modulation (PCM), companded $\mu$-law, or A-law. As known in the art, the speech samples s(n) are organized into frames of input data wherein each frame comprises a predetermined number of digitized speech samples s(n). In an exemplary embodiment, a sampling rate of 8 kHz is employed, with each 20 ms frame comprising 160 samples. In the embodiments described below, the rate of data transmission may advantageously be varied on a frame-to-frame basis from 8 kbps (full rate) to 4 kbps (half rate) to 2 kbps (quarter rate) to 1 kbps (eighth rate). Alternatively, other data rates may be used. As used herein, the terms "full rate" or "high rate" generally refer to data rates that are greater than or equal to 8 kbps, and the terms "half rate" or "low rate" generally refer to data rates that are less than or equal to 4 kbps. Varying the data transmission rate is advantageous because lower bit rates may be selectively employed for frames containing relatively less speech information. As understood by those skilled in the art, other sampling rates, frame sizes, and data transmission rates may be used.

The first encoder 10 and the second decoder 20 together comprise a first speech coder, or speech codec. Similarly, the second encoder 16 and the first decoder 14 together comprise a second speech coder. It is understood by those of skill in the art that speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of writable storage medium known in the art. Alternatively, any conventional processor, controller, or state machine could be substituted for the microprocessor. Exemplary ASICs designed specifically for speech coding are described in U.S. Pat. No. 5,727,123, assigned to the assignee of the present invention and fully incorporated herein by reference, and U.S. application Ser. No. 08/197,417, entitled VOCODER ASIC, filed Feb. 16, 1994, assigned to the assignee of the present invention, and fully incorporated herein by reference.

Figure 2:
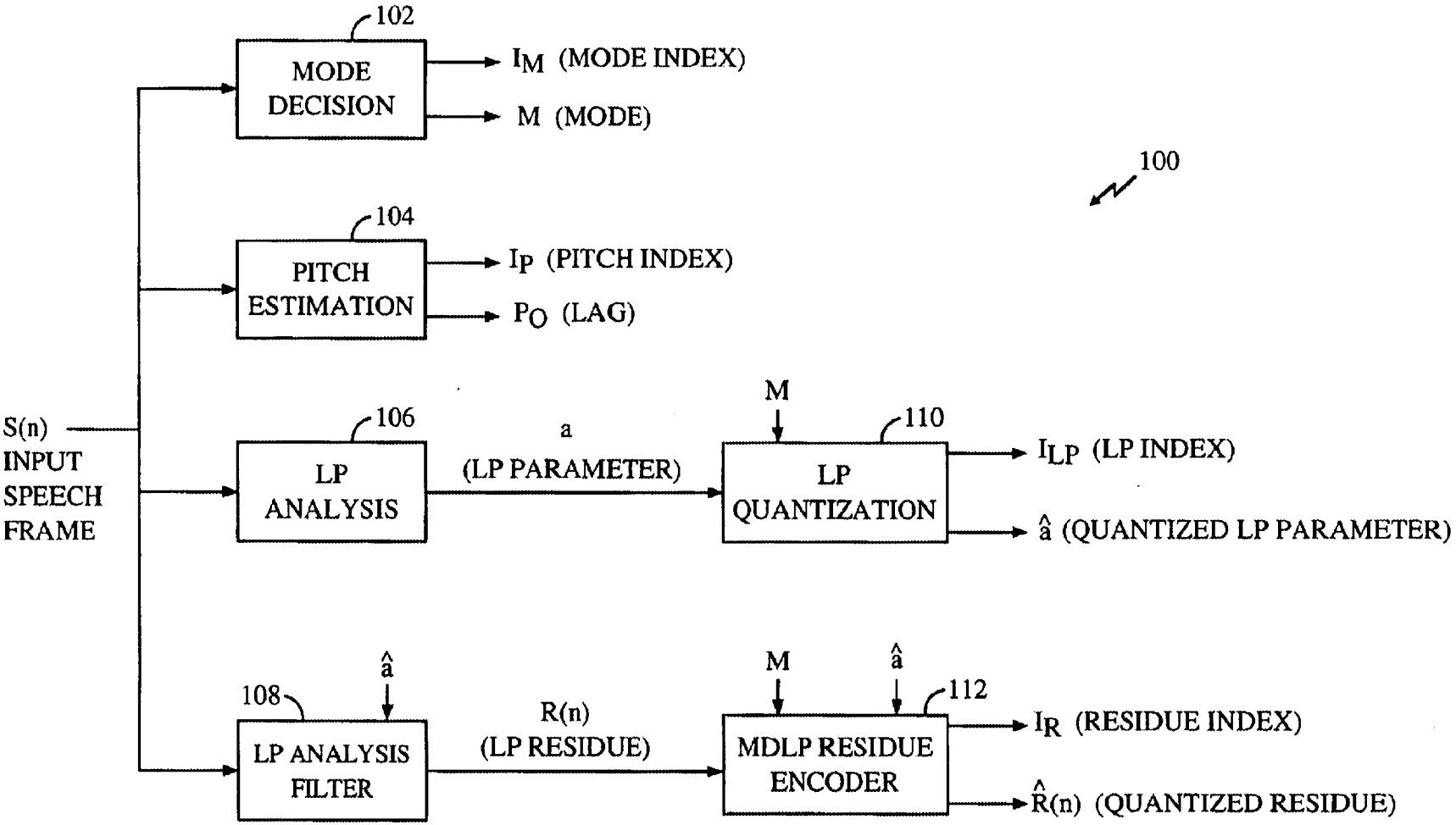
FIG. 2 is a block diagram of an encoder that can be used in a multimode, mixed-domain linear prediction (MDLP) speech coder.

In accordance with one embodiment, as depicted in FIG. 2, a multimode, mixed-domain linear prediction (MDLP) encoder 100 that may be used in a speech coder includes a mode decision module 102, a pitch estimation module 104, a linear prediction (LP) analysis module 106, an LP analysis filter 108, an LP quantization module 110, and an MDLP residue encoder 112. Input speech frames s(n) are provided to the mode decision module 102, the pitch estimation module 104, the LP analysis module 106, and the LP analysis filter 108. The mode decision module 102 produces a mode index $I_M$ and a mode M based upon the periodicity, and other extracted parameters such as energy, spectral tilt, zero crossing rate, etc, of each input speech frame s(n). Various methods of classifying speech frames according to periodicity are described in U.S. application Ser. No. 08/815,354, entitled METHOD AND APPARATUS FOR PERFORMING REDUCED RATE VARIABLE RATE VOCODING, filed Mar. 11, 1997, assigned to the assignee of the present invention, and fully incorporated herein by reference. Such methods are also incorporated into the Telecommunication Industry Association Industry Interim Standards TIA/EIA IS-127 and TIA/EIA IS-733.

The pitch estimation module 104 produces a pitch index $I_P$ and a lag value $P_0$ based upon each input speech frame s(n). The LP analysis module 106 performs linear predictive analysis on each input speech frame s(n) to generate an LP parameter a. The LP parameter a is provided to the LP quantization module 110. The LP quantization module 110 also receives the mode M, thereby performing the quantization process in a mode-dependent manner. The LP quantization module 110 produces an LP index $I_{LP}$ and a quantized LP parameter â. The LP analysis filter 108 receives the quantized LP parameter â in addition to the input speech frame s(n). The LP analysis filter 108 generates an LP residue signal R[n], which represents the error between the input speech frames s(n) and the reconstructed speech based on the quantized linear predicted parameters â. The LP residue R[n], the mode M, and the quantized LP parameter â are provided to the MDLP residue encoder 112. Based upon these values, the MDLP residue encoder 112 produces a residue index $I_R$ and a quantized residue signal $\hat{R}[n]$ in accordance with steps described below with reference to the flow chart of FIG. 4.

Figure 3:
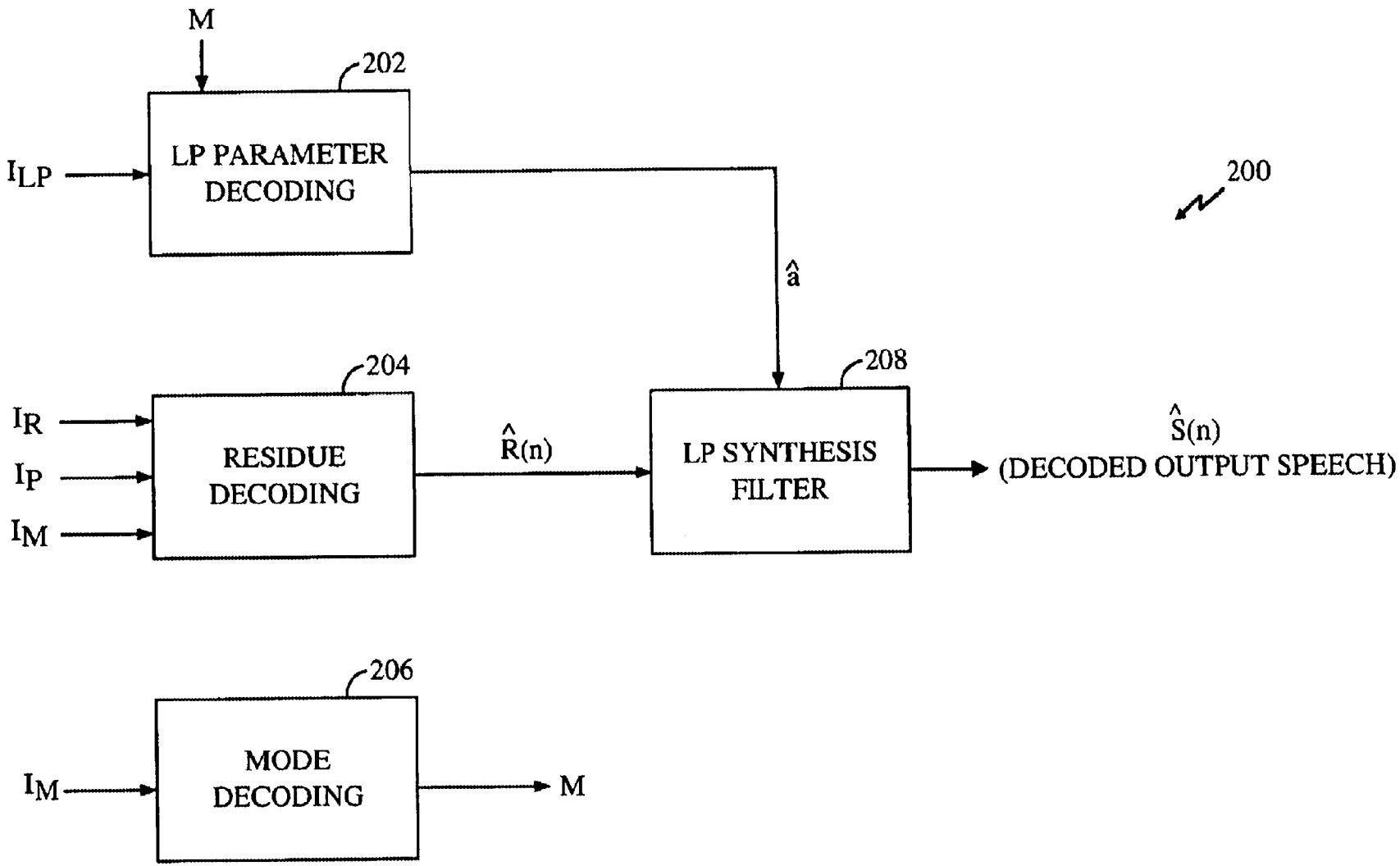
FIG. 3 is a block diagram of a decoder that can be used in a multimode, MDLP speech coder.

In FIG. 3 a decoder 200 that may be used in a speech coder includes an LP parameter decoding module 202, a residue decoding module 204, a mode decoding module 206, and an LP synthesis filter 208. The mode decoding module 206 receives and decodes a mode index $I_M$, generating therefrom a mode M. The LP parameter decoding module 202 receives the mode M and an LP index $I_{LP}$. The LP parameter decoding module 202 decodes the received values to produce a quantized LP parameter â. The residue decoding module 204 receives a residue index $I_R$, a pitch index $I_P$, and the mode index $I_M$. The residue decoding module 204 decodes the received values to generate a quantized residue signal $\hat{R}[n]$. The quantized residue signal $\hat{R}[n]$ and the quantized LP parameter â are provided to the LP synthesis filter 208, which synthesizes a decoded output speech signal $\hat{s}[n]$ therefrom.

With the exception of the MDLP residue encoder 112, operation and implementation of the various modules of the encoder 100 of FIG. 2 and the decoder 200 of FIG. 3 are known in the art and described in the aforementioned U.S. Pat. No. 5,414,796 and L. B. Rabiner & R. W. Schafer, *Digital Processing of Speech Signals* 396–453 (1978).

Figure 4:
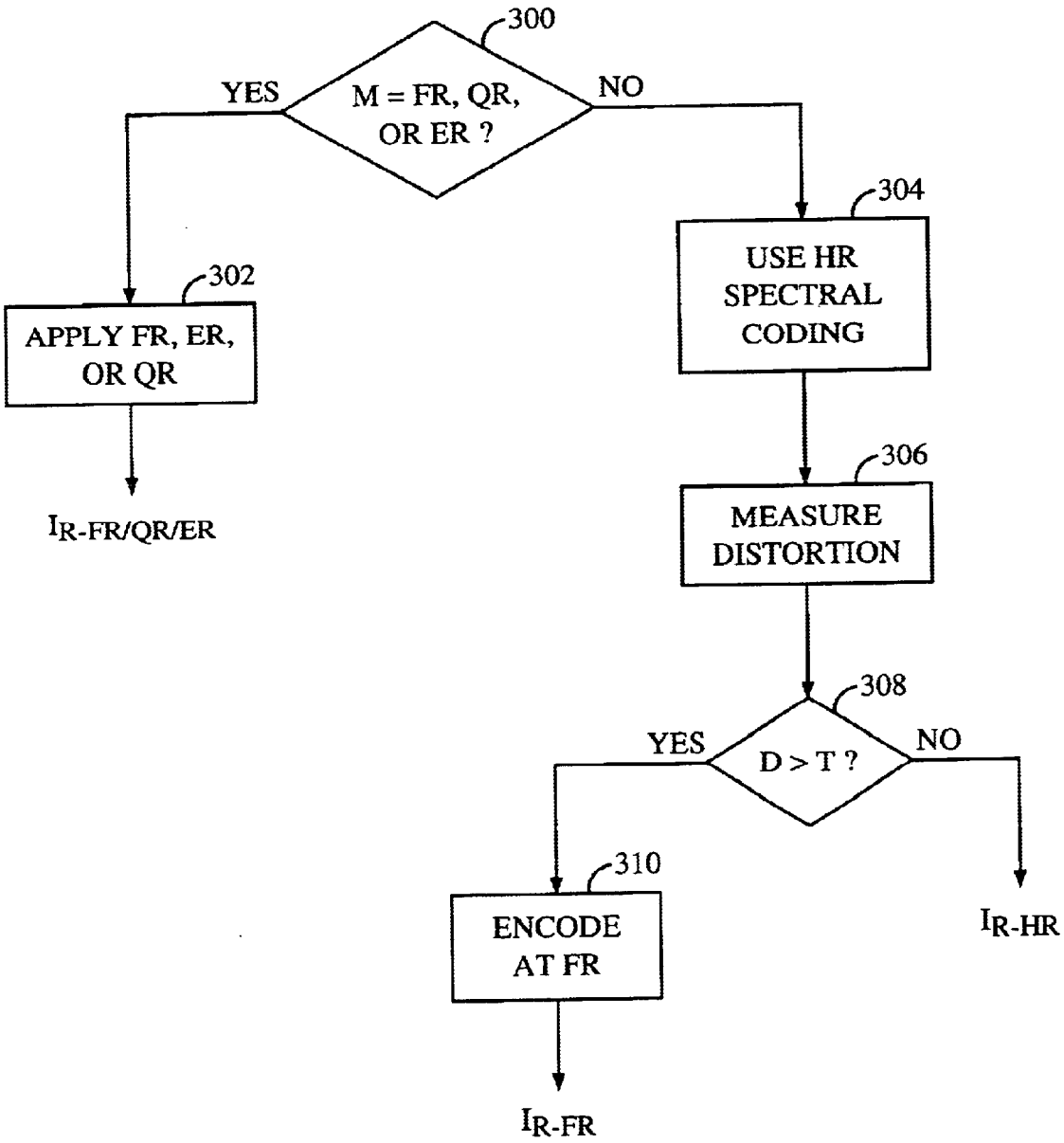
FIG. 4 is a flow chart illustrating MDLP encoding steps performed by an MDLP encoder that could be used in the encoder of FIG. 2.

In accordance with one embodiment, an MDLP encoder (not shown) performs the steps shown in the flow chart of FIG. 4. The MDLP encoder could be the MDLP residue encoder 112 of FIG. 2. In step 300 the MDLP encoder checks whether the mode M is full rate (FR), quarter rate (QR) or eighth rate (ER). If the mode M is FR, QR, or ER, the MDLP encoder proceeds to step 302. In step 302 the MDLP encoder applies the corresponding rate (FR, QR, or ER—depending on the value of M) to the residue index $I_R$. Time-domain coding, which for FR mode is high-precision, high-rate coding, and may advantageously be CELP coding, is applied to an LP residue frame, or, alternatively, to a speech frame. The frame is then transmitted (after further signal processing, including digital-to-analog conversion and modulation). In one embodiment the frame is an LP residue frame representing prediction error. In an alternate embodiment, the frame is a speech frame representing speech samples.

If, on the other hand, in step 300 the mode M was not FR, QR, or ER (i.e., if the mode M is half rate (HR)), the MDLP encoder proceeds to step 304. In step 304 spectral coding, which is advantageously harmonic coding, is applied at half rate to the LP residue, or, alternatively, to the speech signal. The MDLP encoder then proceeds to step 306. In step 306 a distortion measure D is obtained by decoding the encoded speech and comparing it with the original input frame. The MDLP encoder then proceeds to step 308. In step 308 the distortion measure D is compared with a predefined threshold value T. If the distortion measure D is not greater than the threshold T, the corresponding quantized parameters for the half-rate, spectrally encoded frame are modulated and transmitted. If, on the other hand, the distortion measure D is greater than the threshold T, the MDLP encoder proceeds to step 310. In step 310 the decoded frame is re-encoded in the time domain at full rate. Any conventional high-rate, high-precision, coding algorithm may be used, such as, advantageously, CELP coding. The FR-mode quantized parameters associated with the frame are then modulated and transmitted.

Figure 5:
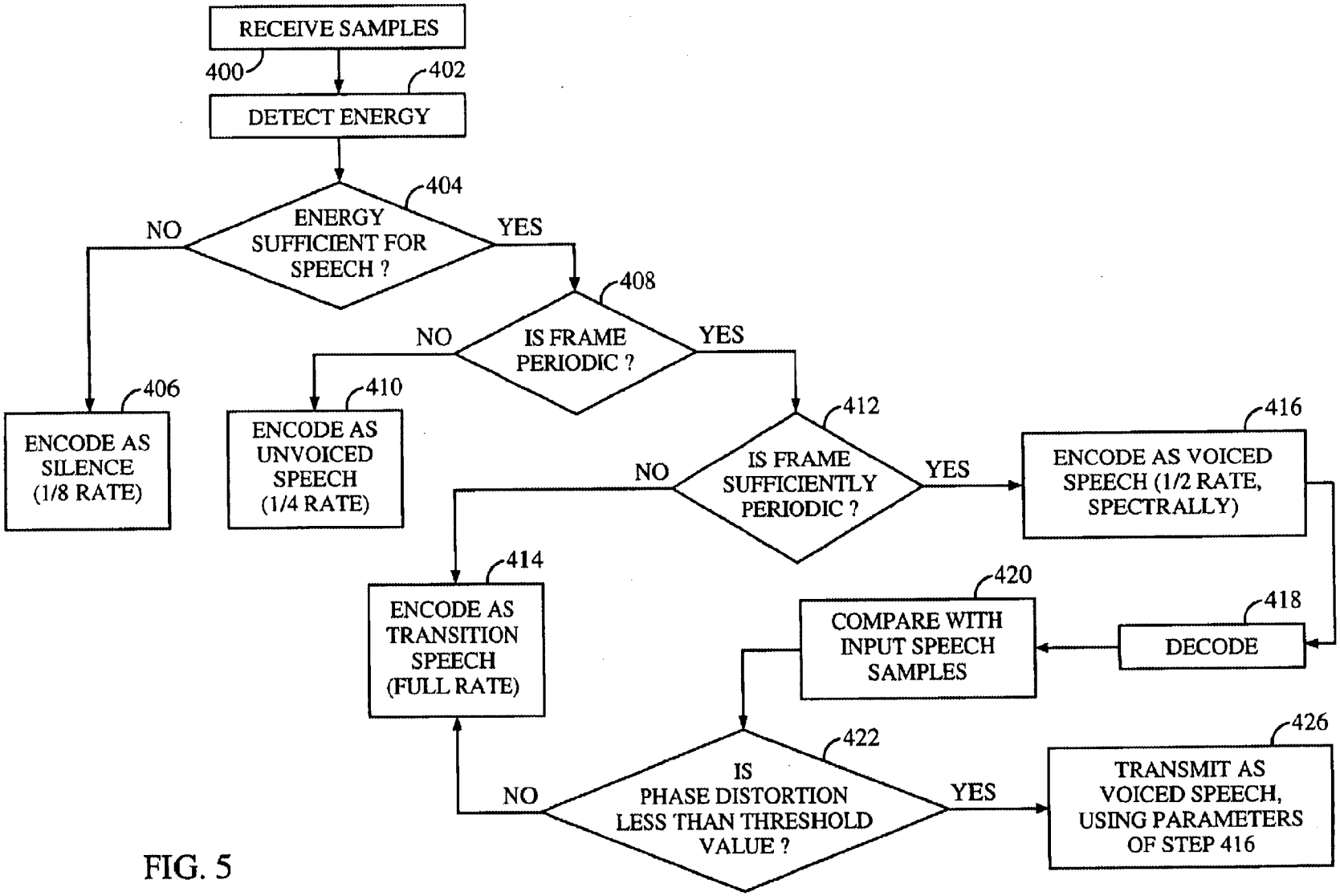
FIG. 5 is a flow chart illustrating a speech coding decision process.

As illustrated in the flow chart of FIG. 5, a closed-loop, multimode, MDLP speech coder in accordance with one embodiment follows a set of steps in processing speech samples for transmission. In step 400 the speech coder receives digital samples of a speech signal in successive frames. Upon receiving a given frame, the speech coder proceeds to step 402. In step 402 the speech coder detects the energy of the frame. The energy is a measure of the speech activity of the frame. Speech detection is performed by summing the squares of the amplitudes of the digitized speech samples and comparing the resultant energy against a threshold value. In one embodiment the threshold value adapts based on the changing level of background noise. An exemplary variable threshold speech activity detector is described in the aforementioned U.S. Pat. No. 5,414,796. Some unvoiced speech sounds can be extremely low-energy samples that may be mistakenly encoded as background noise. To prevent this from occurring, the spectral tilt of low-energy samples may be used to distinguish the unvoiced speech from background noise, as described in the aforementioned U.S. Pat. No. 5,414,796.

After detecting the energy of the frame, the speech coder proceeds to step 404. In step 404 the speech coder determines whether the detected frame energy is sufficient to classify the frame as containing speech information. If the detected frame energy falls below a predefined threshold level, the speech coder proceeds to step 406. In step 406 the speech coder encodes the frame as background noise (i.e., nonspeech, or silence). In one embodiment the background noise frame is time-domain encoded at ⅛ rate, or 1 kbps. If in step 404 the detected frame energy meets or exceeds the predefined threshold level, the frame is classified as speech and the speech coder proceeds to step 408.

In step 408 the speech coder determines whether the frame is periodic. Various known methods of periodicity determination include, e.g., the use of zero crossings and the use of normalized autocorrelation functions (NACFs). In particular, using zero crossings and NACFs to detect periodicity is described in U.S. application Ser. No. 08/815,354, entitled METHOD AND APPARATUS FOR PERFORMING REDUCED RATE VARIABLE RATE VOCODING, filed Mar. 11, 1997, assigned to the assignee of the present invention, and fully incorporated herein by reference. In addition, the above methods used to distinguish voiced speech from unvoiced speech are incorporated into the Telecommunication Industry Association Industry Interim Standards TIA/EIA IS-127 and TIA/EIA IS-733. If the frame is not determined to be periodic in step 408, the speech coder proceeds to step 410. In step 410 the speech coder encodes the frame as unvoiced speech. In one embodiment unvoiced speech frames are time-domain encoded at ¼ rate, or 2 kbps. If in step 408 the frame is determined to be periodic, the speech coder proceeds to step 412.

In step 412 the speech coder determines whether the frame is sufficiently periodic, using periodicity detection methods that are known in the art, as described in, e.g., the aforementioned U.S. application Ser. No. 08/815,354. If the frame is not determined to be sufficiently periodic, the speech coder proceeds to step 414. In step 414 the frame is time-domain encoded as transition speech (i.e., transition from unvoiced speech to voiced speech). In one embodiment the transition speech frame is time-domain encoded at full rate, or 8 kbps.

If in step 412 the speech coder determines that the frame is sufficiently periodic, the speech coder proceeds to step 416. In step 416 the speech coder encodes the frame as voiced speech. In one embodiment voiced speech frames are encoded spectrally at half rate, or 4 kbps. Advantageously, the voiced speech frames are spectrally encoded with a harmonic coder, as described below with reference to FIG. 7. Alternatively, other spectral coders could be used, such as, e.g., sinusoidal transform coders or multiband excitation coders, as known in the art. The speech coder then proceeds to step 418. In step 418 the speech coder decodes the encoded voiced speech frame. The speech coder then proceeds to step 420. In step 420 the decoded voiced speech frame is compared with the corresponding input speech samples for that frame to achieve a measure of synthesized speech distortion and to determine whether the half-rate, voiced-speech, spectral coding model is operating within acceptable limits. The speech coder then proceeds to step 422.

In step 422 the speech coder determines whether the error between the decoded voiced speech frame and the input speech samples corresponding to that frame falls below a predefined threshold value. In accordance with one embodiment, this determination is made in the manner described below with reference to FIG. 6. If the encoding distortion falls below the predefined threshold value, the speech coder proceeds to step 426. In step 426 the speech coder transmits the frame as voiced speech, using the parameters of step 416. If in step 422 the encoding distortion meets or exceeds the predefined threshold value, the speech coder proceeds to step 414, time-domain encoding the frame of digitized speech samples received in step 400 as transition speech, at full rate.

It should be pointed out that steps 400–410 comprise an open-loop, encoding-decision mode. Steps 412–426, on the other hand, comprise a closed-loop, encoding-decision mode.

Figure 6:
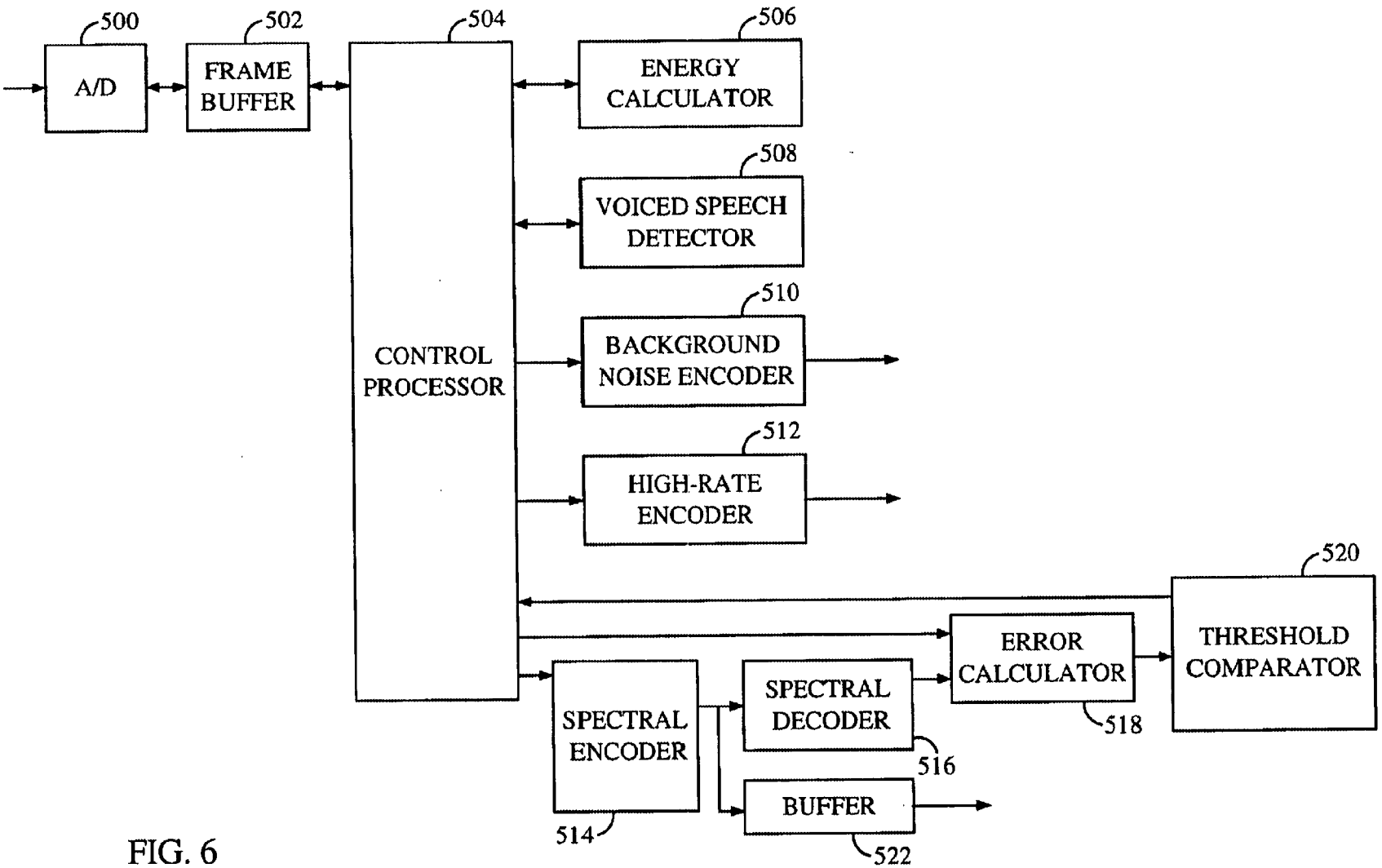
FIG. 6 is a block diagram of a closed-loop, multimode, MDLP speech coder.

In one embodiment, shown in FIG. 6, a closed-loop, multimode, MDLP speech coder includes an analog-to-digital converter (A/D) 500 coupled to a frame buffer 502, which, in turn, is coupled to a control processor 504. An energy calculator 506, a voiced speech detector 508, a background noise encoder 510, a high-rate, time-domain encoder 512, and a low-rate, spectral encoder 514 are coupled to the control processor 504. A spectral decoder 516 is coupled to the spectral encoder 514, and an error calculator 518 is coupled to the spectral decoder 516 and to the control processor 504. A threshold comparator 520 is coupled to the error calculator 518 and to the control processor 504. A buffer 522 is coupled to the spectral encoder 514, the spectral decoder 516, and the threshold comparator 520.

In the embodiment of FIG. 6, the speech coder components are advantageously implemented as firmware or other software-driven modules in the speech coder, which itself advantageously resides in a DSP or an ASIC. Those skilled in the art would understand that the speech coder components could equally well be implemented in a number of other known ways. The control processor 504 may advantageously be a microprocessor, but could otherwise be implemented with a controller, state machine, or discrete logic.

In the multimode coder of FIG. 6, speech signals are provided to the A/D 500. The A/D 500 converts the analog signals to frames of digitized speech samples, S(n). The digitized speech samples are provided to the frame buffer 502. The control processor 504 takes the digitized speech samples from the frame buffer 502 and provides them to the energy calculator 506. The energy calculator 506 computes the energy, E, of the speech samples in accordance with the following equation:

$$E = \sum_{n=0}^{159} S^2(n)$$

where the frames are 20 ms long and the sampling rate is 8 kHz. The calculated energy, E, is sent back to the control processor 504.

The control processor 504 compares the calculated speech energy with a speech activity threshold. If the calculated energy is below the speech activity threshold, the control processor 504 directs the digitized speech samples from the frame buffer 502 to the background noise encoder 510. The background noise encoder 510 encodes the frame using the minimal number of bits necessary to preserve an estimate of the background noise.

If the calculated energy is greater than or equal to the speech activity threshold, the control processor 504 directs the digitized speech samples from the frame buffer 502 to the voiced speech detector 508. The voiced speech detector 508 determines whether the speech frame periodicity would allow for efficient coding using a low-bit-rate spectral encoding. Methods for determining the level of periodicity in a speech frame are well known in the art and include, e.g., the use of normalized autocorrelation functions (NACFs) and zero crossings. These methods and others are described in the aforementioned U.S. application Ser. No. 08/815,354.

The voiced speech detector 508 provides a signal to the control processor 504 indicating whether the speech frame contains speech of sufficient periodicity to be efficiently encoded by the spectral encoder 514. If the voiced speech detector 508 determines that the speech frame lacks sufficient periodicity, the control processor 504 directs the digitized speech samples to the high-rate encoder 512, which time-domain encodes the speech at a predetermined maximum data rate. In one embodiment the predetermined maximum data rate is 8 kbps, and the high-rate encoder 512 is a CELP coder.

If the voiced speech detector 508 initially determines that the speech signal has sufficient periodicity to be efficiently encoded by the spectral encoder 514, the control processor 504 directs the digitized speech samples from the frame buffer 502 to the spectral encoder 514. An exemplary spectral encoder is described in detail below with reference to FIG. 7.

The spectral encoder 514 extracts the estimated pitch frequency, $F_0$, the amplitudes, $A_l$, of the harmonics of the pitch frequency, and voicing information $V_c$. The spectral encoder 514 provides these parameters to the buffer 522 and to the spectral decoder 516. The spectral decoder 516 may advantageously be analogous to the encoder's decoder in traditional CELP encoders. The spectral decoder 516 generates synthesized speech samples, $$\hat{S}(n),$$

in accordance with a spectral decoding format (described below with reference to FIG. 7) and provides the synthesized speech samples to the error calculator 518. The control processor 504 sends the speech samples, S(n), to the error calculator 518.

The error calculator 518 computes the mean square error (MSE) between each speech sample, S(n), and each corresponding synthesized speech sample, $$\hat{S}(n),$$

in accordance with the following equation:

$$MSE = \sum_{n=0}^{159} \left(S(n) - \hat{S}(n)\right)^2$$

The computed MSE is provided to the threshold comparator 520, which determines whether the level of distortion is within acceptable bounds, i.e., whether the level of distortion falls below a predefined threshold value.

If the computed MSE is within acceptable bounds, the threshold comparator 520 provides a signal to the buffer 502 and the spectrally encoded data is output from the speech coder. If, on the other hand, the MSE is not within acceptable limits, the threshold comparator 520 provides a signal to the control processor 504, which, in turn, directs the digitized samples from the frame buffer 502 to the high-rate, time-domain encoder 512. The time-domain encoder 512 encodes the frames at a predetermined maximum rate, and the contents of the buffer 522 are discarded.

In the embodiment of FIG. 6, the type of spectral coding employed is harmonic coding, as described below with reference to FIG. 7, but could in the alternative be any type of spectral coding such as, e.g., sinusoidal transform coding or multiband excitation coding. The use of multiband excitation coding is described in, e.g., U.S. Pat. No. 5,195,166, and the use of sinusoidal transform coding is described in, e.g., U.S. Pat. No. 4,865,068.

For transition frames, and for voiced frames for which the phase distortion threshold value equals or falls below the periodicity parameter, the multimode coder of FIG. 6 advantageously employs CELP coding at full rate, or 8 kbps, by means of the high-rate, time-domain encoder 512. Alternatively, any other known form of high-rate, time-domain coding could be used for such frames. Thus, transition frames (and voiced frames that are not sufficiently periodic) are coded with high precision so that the waveforms at input and output are well matched, with phase information being well preserved. In one embodiment the multimode coder switches from half-rate spectral coding to full-rate CELP coding for one frame, without regard to the determination of the threshold comparator 520, after a predefined number of consecutive voiced frames for which the threshold value exceeds the periodicity measure is processed.

It should be pointed out that in conjunction with the control processor 504, the energy calculator 506 and the voiced speech detector 508 comprise open-loop encoding decisions. In contrast, in conjunction with the control processor 504, the spectral encoder 514, spectral decoder 516, error calculator 518, threshold comparator 520, and buffer 522 comprise a closed-loop encoding decision.

In one embodiment, described with reference to FIG. 7, spectral coding, and advantageously harmonic coding, is used to encode sufficiently periodic voiced frames at a low bit rate. Spectral coders generally are defined as algorithms that attempt to preserve the time-evolution of speech spectral characteristics in a perceptually meaningful way by modeling and encoding each frame of speech in the frequency domain. The essential parts of such algorithms are: (1) spectral analysis or parameter estimation; (2) parameter quantization; and (3) synthesis of the output speech waveform with the decoded parameters. Thus, the objective is to preserve the important characteristics of the short-term speech spectrum with a set of spectral parameters, encode the parameters, and then synthesize the output speech using the decoded spectral parameters. Typically, the output speech is synthesized as a weighted sum of sinusoids. The amplitudes, frequencies, and phases of the sinusoids are the spectral parameters estimated during analysis.

While "analysis by synthesis" is a well-known technique in CELP coding, the technique is not exploited in spectral coding. The primary reason that analysis by synthesis is not applied to spectral coders is that due to the loss of initial phase information, the mean square energy (MSE) of the synthesized speech may be high even though the speech model is functioning properly from a perceptual standpoint. Thus, another advantage of accurately generating the initial phase is the resultant capability to directly compare the speech samples and the reconstructed speech to allow for the determination of whether the speech model is accurately encoding speech frames.

In spectral coding, the output speech frame is synthesized as $$S[n]=S_v[n]+S_{uv}[n],\ n=1,2,\ldots N,$$

where N is the number of samples per frame and $S_v$ and $S_{uv}$ are the voiced and unvoiced components, respectively. A sum-of-sinusoid synthesis process creates the voiced component as follows:

$$S[n]=\sum_{k=1}^{L} A(k,n)\bullet\cos(2\pi n f_k+\theta(k,n))$$

where L is the total number of sinusoids, $f_k$ are the frequencies of interest in the short-term spectrum, A(k,n) are the amplitudes of the sinusoids, and θ(k,n) are the phases of the sinusoids. The amplitude, frequency, and phase parameters are estimated from the short-term spectrum of the input frame by a spectral analysis process. The unvoiced component can be created together with the voiced part in a single sum-of-sinusoid synthesis, or it can be computed separately by a dedicated unvoiced-synthesis process and then added back to $S_v$.

Figure 7:
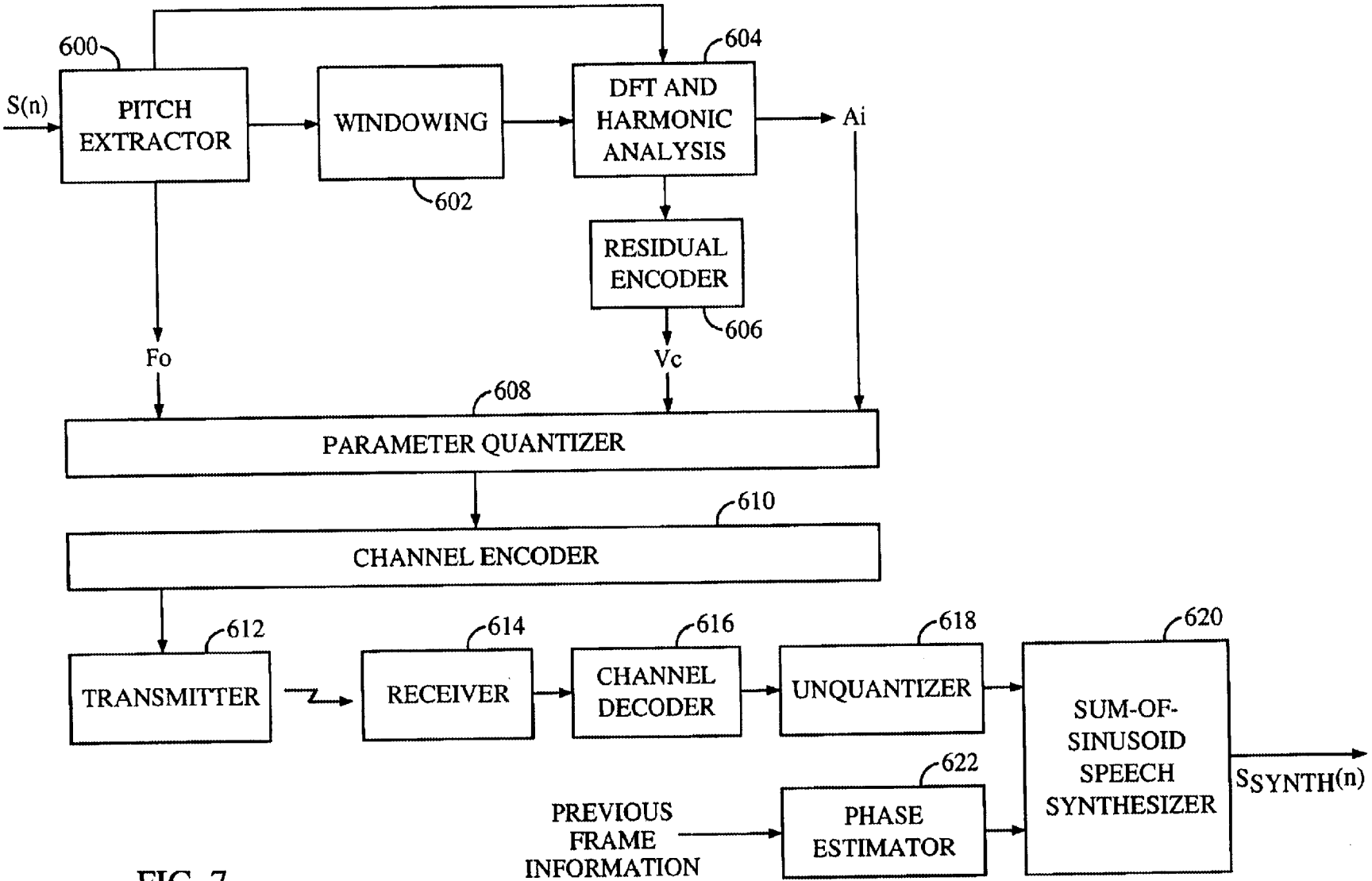
FIG. 7 is a block diagram of a spectral coder that could be used in the coder of FIG. 6 or the encoder of FIG. 2.
Figure 8:
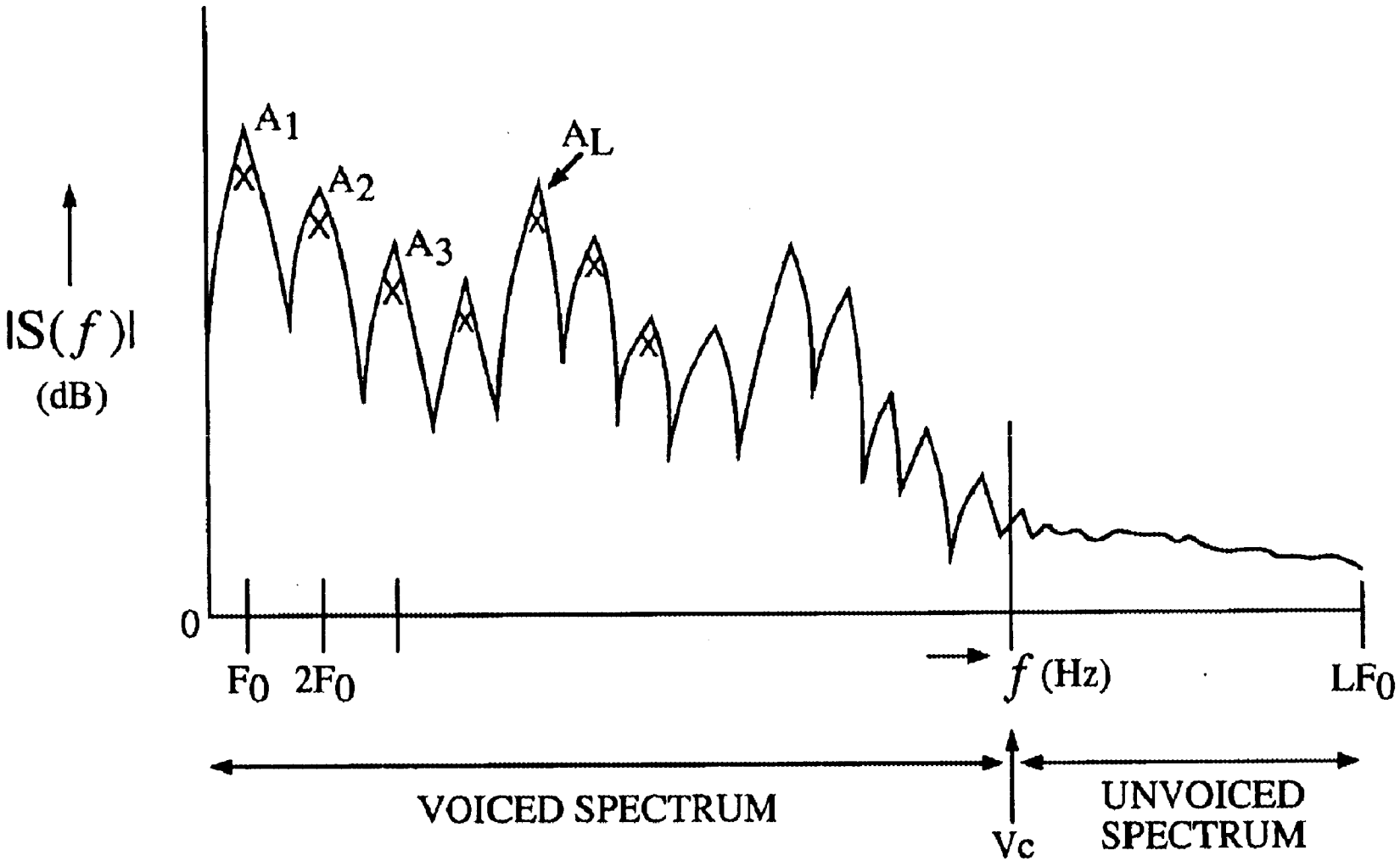
FIG. 8 is a graph of amplitude versus frequency, illustrating amplitudes of sinusoids in a harmonic coder.

In the embodiment of FIG. 7, a particular type of spectral coder called a harmonic coder is used to spectrally encode sufficiently periodic voiced frames at a low bit rate. Harmonic coders characterize a frame as a sum of sinusoids, analyzing small segments of the frame. Each sinusoid in the sum of sinusoids has a frequency that is an integer multiple of the pitch, $F_0$, of the frame. In an alternate embodiment, in which the particular type of spectral coder used is other than a harmonic coder, the sinusoid frequencies for each frame are taken from a set of real numbers between 0 and 2π. In the embodiment of FIG. 7, the amplitudes and phases of each sinusoid in the sum are advantageously selected so that the sum will best match the signal over one period, as illustrated by the graph of FIG. 8. Harmonic coders typically employ an external classification, labeling each input speech frame as voiced or unvoiced. For a voiced frame, the frequencies of the sinusoids are restricted to the harmonics of the estimated pitch ($F_o$), i.e., $f_k=kF_o$. For unvoiced speech, the peaks of the short-term spectrum are used to determine the sinusoids. The amplitudes and the phases are interpolated to mimic their evolution over the frame as:

$$A(k,n)=C_1(k)*n+C_2(k)$$

$$\theta(k,n)=B_1(k)*n^2+B_2(k)*n+B_3(k)$$

where the coefficients [Ci(k), Bi(k)] are estimated from the instantaneous values of the amplitudes, frequencies, and phases at the specified frequency locations $f_k$ (=$kf_0$), out of the short-term Fourier Transform (STFT) of a windowed input speech frame. The parameters to be transmitted per sinusoid are the amplitude and frequency. The phase is not transmitted, but is instead modeled in accordance with any of several known techniques including, e.g., the quadratic phase model.

As illustrated in FIG. 7, a harmonic coder includes a pitch extractor 600 coupled to windowing logic 602 and to Discrete Fourier Transform (DFT) and harmonic analysis logic 604. The pitch extractor 600, which receives speech samples, S(n), as an input, is also coupled to the DFT and harmonic analysis logic 604. The DFT and harmonic analysis logic 604 is coupled to a residual encoder 606. The pitch extractor 600, the DFT and harmonic analysis logic 604, and the residual encoder 606 are each coupled to a parameter quantizer 608. The parameter quantizer 608 is coupled to a channel encoder 610, which, in turn, is coupled to a transmitter 612. The transmitter 612 is coupled by means of a standard radio-frequency (RF) interface such as, e.g., a code division multiple access (CDMA) over-the-air interface, to a receiver 614. The receiver 614 is coupled to a channel decoder 616, which, in turn, is coupled to an unquantizer 618. The unquantizer 618 is coupled to a sum-of-sinusoid speech synthesizer 620. Also coupled to the sum-of-sinusoid speech synthesizer 620 is a phase estimator 622, which receives previous frame information as an input. The sum-of-sinusoid speech synthesizer 620 is configured to generate a synthesized speech output, $S_{SYNTH}(n)$.

The pitch extractor 600, windowing logic 602, DFT and harmonic analysis logic 604, residual encoder 606, parameter quantizer 608, channel encoder 610, channel decoder 616, unquantizer 618, sum-of-sinusoid speech synthesizer 620, and phase estimator 622 can be implemented in a variety of different ways known to those of skill in the art, including, e.g., firmware or software modules. The transmitter 612 and the receiver 614 may be implemented with any equivalent standard RF components known to those of skill in the art.

In the harmonic coder of FIG. 7, input samples, S(n), are received by the pitch extractor 600, which extracts pitch frequency information $F_0$. The samples are then multiplied by a suitable windowing function by the windowing logic 602 to allow for analysis of small segments of a speech frame. Using the pitch information supplied by the pitch extractor 600, the DFT and harmonic analysis logic 604 computes the DFT of the samples to generate complex spectral points from which harmonic amplitudes, $A_l$, are extracted, as illustrated by the graph of FIG. 8, in which L denotes the total number of harmonics. The DFT is provided to the residual encoder 606, which extracts voicing information, $V_c$.

It should be pointed out that the $V_c$ parameter denotes a point on the frequency axis, as shown in FIG. 8, above which the spectrum is characteristic of an unvoiced speech signal and is no longer harmonic. In contrast, below the point $V_c$, the spectrum is harmonic and characteristic of voiced speech.

The $A_l$, $F_0$, and $V_c$ components are provided to the parameter quantizer 608, which quantizes the information. The quantized information is provided in the form of packets to the channel encoder 610, which quantizes the packets at a low bit rate such as, e.g., half rate, or 4 kbps. The packets are provided to the transmitter 612, which modulates the packets and transmits the resultant signal over the air to the receiver 614. The receiver 614 receives and demodulates the signal, passing the encoded packets to the channel decoder 616. The channel decoder 616 decodes the packets and provides the decoded packets to the unquantizer 618. The unquantizer 618 unquantizes the information. The information is provided to the sum-of-sinusoid speech synthesizer 620.

The sum-of-sinusoid speech synthesizer 620 is configured to synthesize a plurality of sinusoids modeling the short-term speech spectrum in accordance with the above equation for S[n]. The frequencies of the sinusoids, $f_k$, are multiples or harmonics of the fundamental frequency, $F_0$, which is the frequency of pitch periodicity for quasi-periodic (i.e., transition) voiced speech segments.

The sum-of-sinusoid speech synthesizer 620 also receives phase information from the phase estimator 622. The phase estimator 622 receives previous frame information, i.e., the $A_l$, $F_0$, and $V_c$ parameters for the immediately preceding frame. The phase estimator 622 also receives the reconstructed N samples of the previous frame, where N is the frame length (i.e., N is the number of samples per frame). The phase estimator 622 determines the initial phase for the frame based upon the information for the previous frame. The initial phase determination is provided to the sum-of-sinusoid speech synthesizer 620. Based upon the information for the current frame, and the initial phase calculation performed by the phase estimator 622 based on the past frame information, the sum-of-sinusoid speech synthesizer 620 produces synthetic speech frames, as described above.

As described above, harmonic coders synthesize, or reconstruct, speech frames by using previous frame information and predicting that the phase varies linearly from frame to frame. In the synthesis model described above, which is commonly referred to as the quadratic phase model, the coefficient $B_3(k)$ represents the initial phase for the current voiced frame being synthesized. In determining the phase, conventional harmonic coders either set the initial phase to zero or generate an initial phase value randomly or with some pseudo-random generation method. In order to more accurately predict the phase, the phase estimator 622 uses one of two possible methods for determining the initial phase, depending upon whether the immediately preceding frame was determined to be a voiced speech frame (i.e., a sufficiently periodic frame) or a transition speech frame. If the previous frame was a voiced speech frame, the final estimated phase value of that frame is used as the initial phase value of the current frame. If, on the other hand, the previous frame was classified as a transition frame, the initial phase value for the current frame is obtained from the spectrum of the previous frame, which is obtained by performing a DFT of the decoder output for the previous frame. Thus, the phase estimator 622 makes use of accurate phase information (because the previous frame, being a transition frame, was processed at full rate) that is already available.

Figure 9:
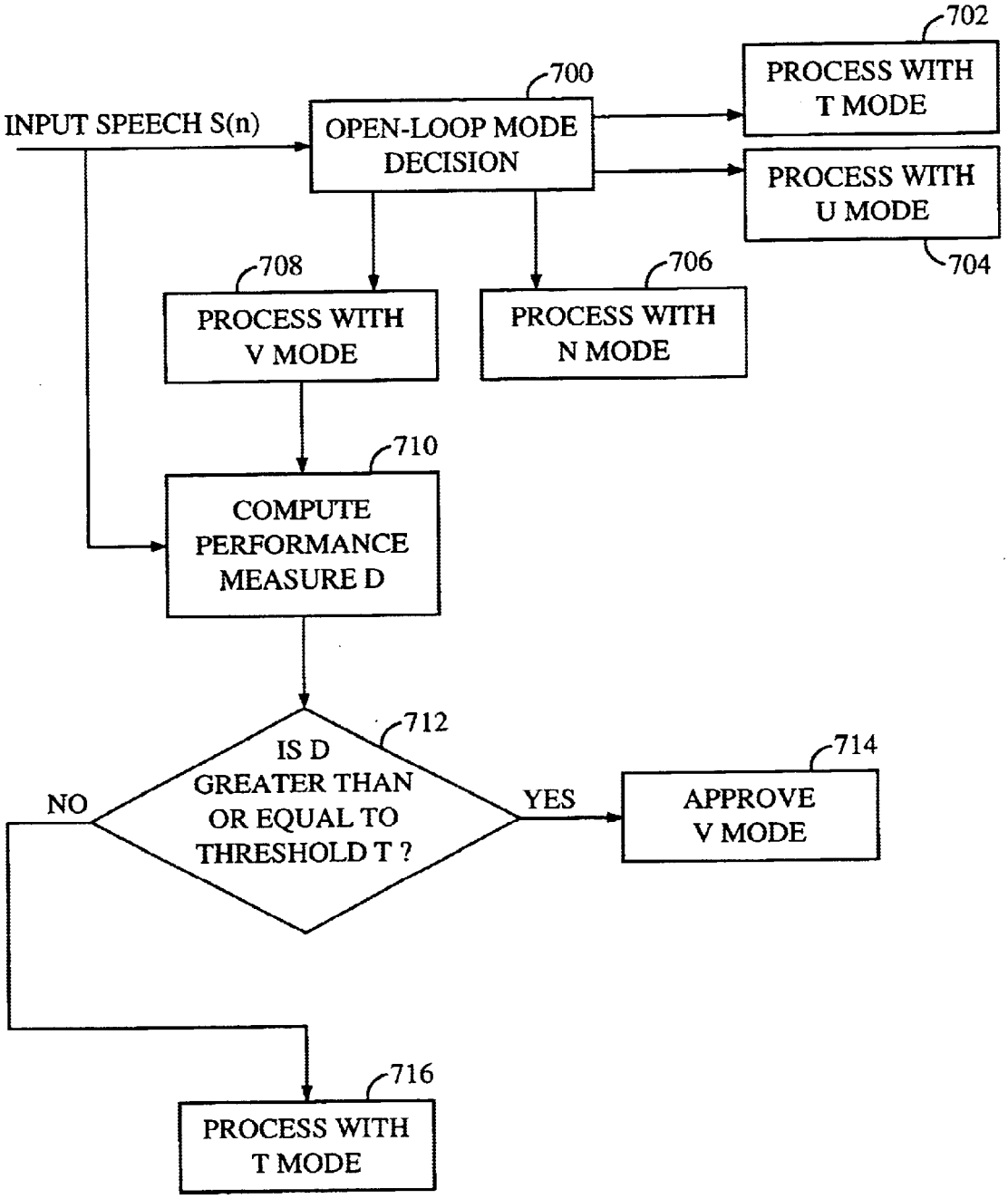
FIG. 9 is a flow chart illustrating a mode decision process in a multimode, MDLP speech coder.

In one embodiment a closed-loop, multimode, MDLP speech coder follows the speech processing steps depicted in the flow chart of FIG. 9. The speech coder encodes the LP residue of each input speech frame by choosing the most appropriate encoding mode. Certain modes encode the LP residue, or the speech residue, in the time domain, while other modes represent the LP residue, or the speech residue, in the frequency domain. The set of modes is full rate, time domain for transition frames (T mode); half rate, frequency domain for voiced frames (V mode); quarter rate, time domain for unvoiced frames (U mode); and eighth rate, time domain for noise frames (N mode).

Figure 10:
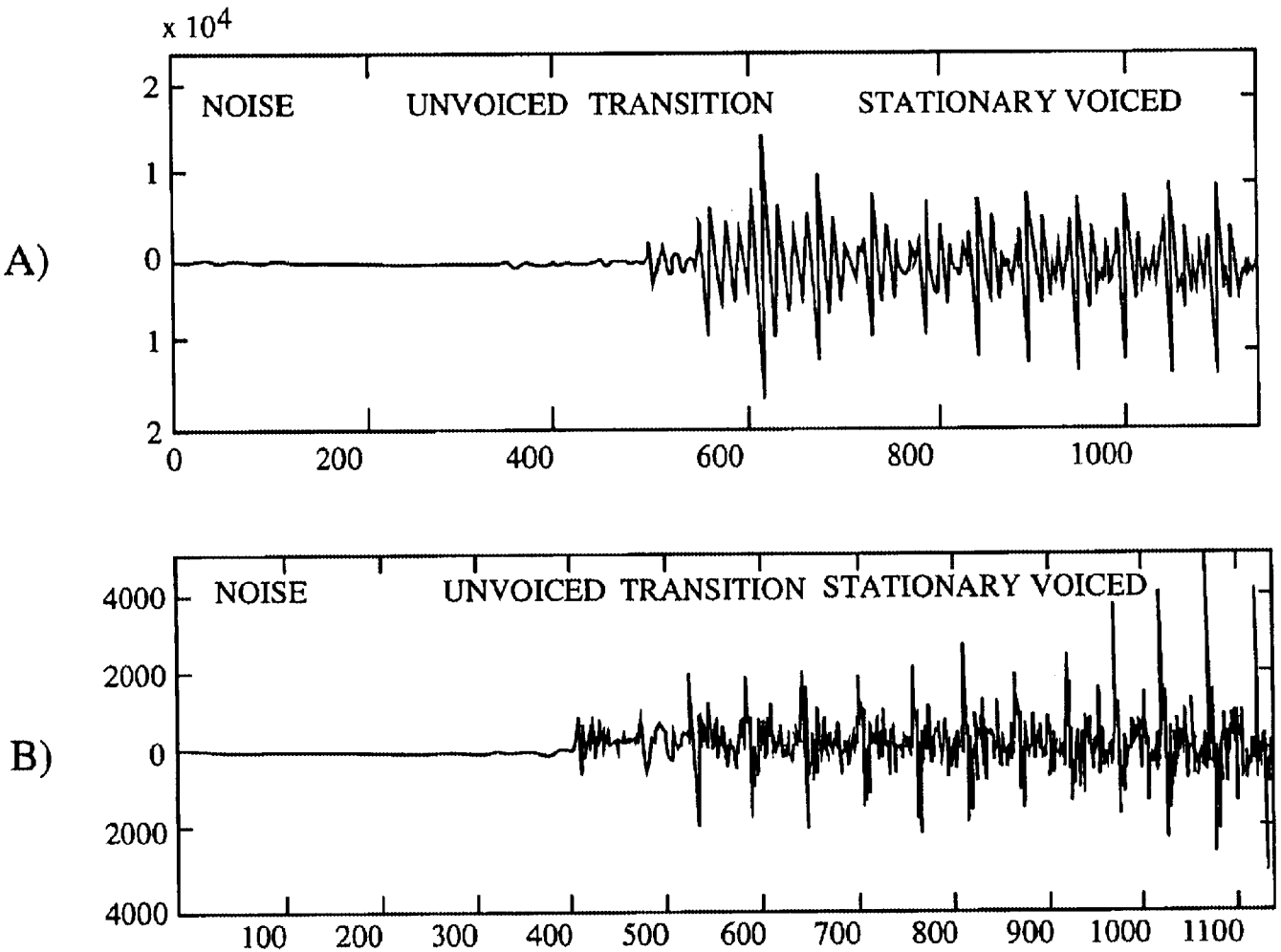
FIG. 10A is a graph speech signal amplitude versus time.
FIG. 10B is a graph of linear prediction (LP) residue amplitude versus time.

Those of skill would appreciate that either the speech signal or the corresponding LP residue may be encoded by following the steps shown in FIG. 9. The waveform characteristics of noise, unvoiced, transition, and voiced speech can be seen as a function of time in the graph of FIG. 10A. The waveform characteristics of noise, unvoiced, transition, and voiced LP residue can be seen as a function of time in the graph of FIG. 10B.

In step 700 an open-loop mode decision is made regarding which one of the four modes (T, V, U, or N) to apply to input speech residue, S(n). If T mode is to be applied, the speech residue is processed under T mode, i.e., at full rate, in the time domain, in step 702. If U mode is to be applied, the speech residue is processed under U mode, i.e., at quarter rate, in the time domain, in step 704. If N mode is to be applied, the speech residue is processed under N mode, i.e., at eighth rate, in the time domain, in step 706. If V mode is to be applied, the speech residue is processed under V mode, i.e., at half rate, in the frequency domain, in step 708.

In step 710 the speech encoded in step 708 is decoded and compared with the input speech residue, S(n), and a performance measure, D, is computed. In step 712 the performance measure, D, is compared with a predefined threshold value, T. If the performance measure, D, is greater than or equal to the threshold, T, the spectrally encoded speech residue of step 708 is approved for transmission, in step 714. If, on the other hand, the performance measure, D, is less than the threshold, T, the input speech residue, S(n), is processed under the T mode, in step 716. In an alternate embodiment, no performance measure is computed, and no threshold value is defined. Instead, after a predefined number of speech residue frames has been processed under the V mode, the next frame is processed under the T mode.

Advantageously, the decision steps shown in FIG. 9 allow the high-bit-rate T mode to be used only when necessary, exploiting the periodicity of voiced speech segments with the lower-bit-rate V mode while preventing any lapse in quality by switching to full rate when the V mode does not perform adequately. Accordingly, an extremely high voice quality approaching the voice quality of full rate may be generated at an average rate that is significantly lower than full rate. Moreover, the target voice quality can be controlled by the performance measure selected and the threshold chosen.

Figure 11:
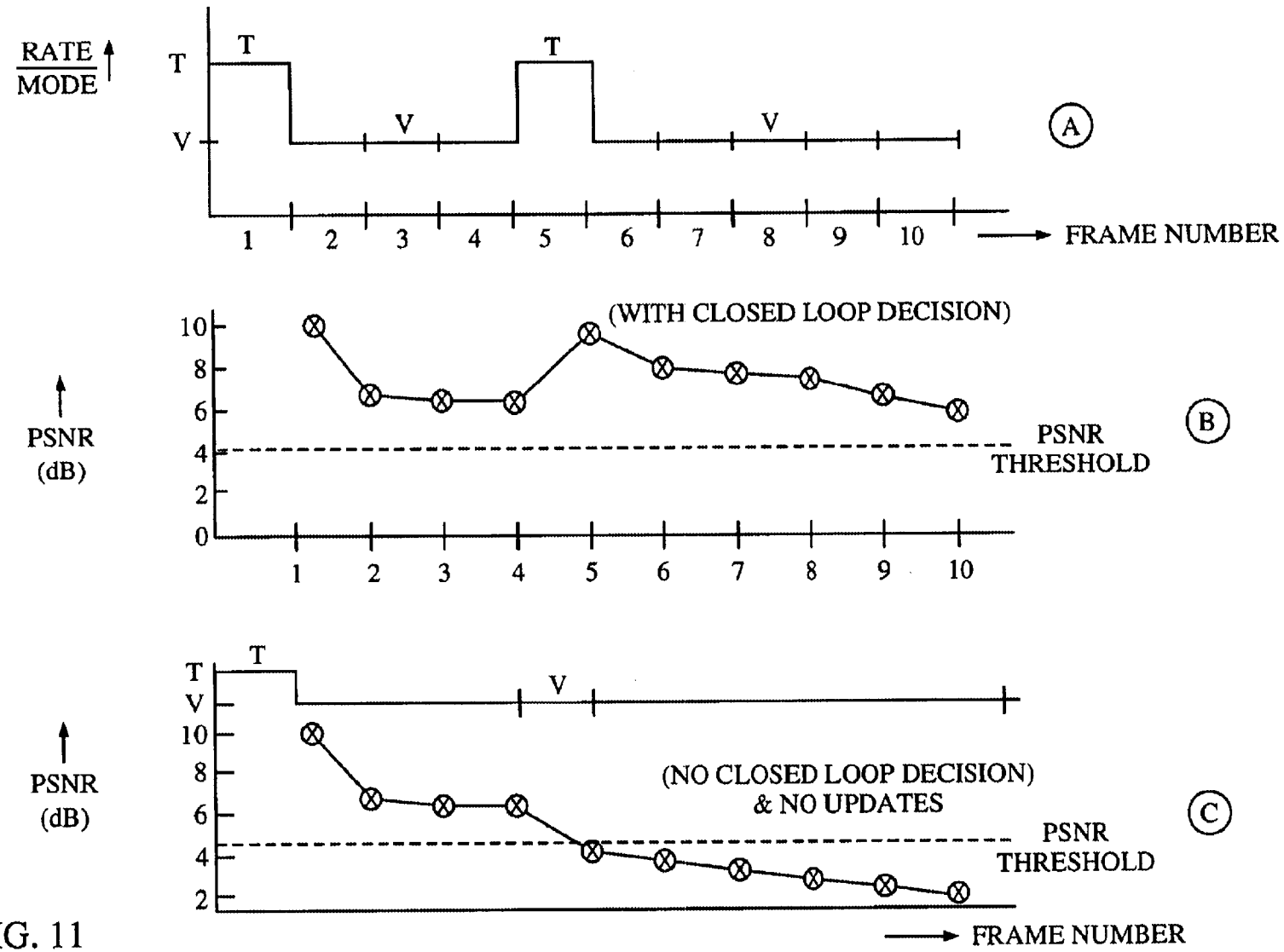
FIG. 11A is a graph of rate/mode versus frame index under a closed-loop encoding decision.
FIG. 11B is a graph of perceptual signal-to-noise ratio (PSNR) versus frame index under a closed-loop decision.
FIG. 11C is a graph of both rate/mode and PSNR versus frame index in the absence of a closed-loop encoding decision.

The "updates" to the T mode also improve the performance of subsequent applications of the V mode by keeping the model phase track close to the phase track of the input speech. When the performance in the V mode is inadequate, the closed-loop performance check of steps 710 and 712 switches to the T mode, and thereby improves the performance of subsequent V-mode processing by "refreshing" the initial phase value, which allows the model phase track to become close again to the original input speech phase track. By way of example, as shown in the graphs of FIGS. 11A–C, the fifth frame from the start does not perform adequately in the V mode, as evidenced by the PSNR distortion measure used. Consequently, without a closed-loop decision and update, the modeled phase track deviates significantly from the original input speech phase track, leading to a severe degradation in PSNR, as shown in FIG. 11C. Moreover, performance for subsequent frames processed under the V mode degrades. Under a closed-loop decision, however, the fifth frame is switched to T-mode processing, as shown in FIG. 11A. The performance of the fifth frame is significantly improved by the update, as evidenced by the improvement in PSNR, as shown in FIG. 11B. Moreover, the performance of subsequent frames processed under the V mode also improves.

The decision steps shown in FIG. 9 improve the quality of the V-mode representation by providing an extremely accurate initial phase estimate value, ensuring that a resultant V-mode-synthesized speech residue signal is accurately time-aligned with the original input speech residue, S(n). The initial phase for the first V-mode-processed speech residue segment is derived from the immediately preceding decoded frame in the following manner. For each harmonic, the initial phase is set equal to the final estimated phase of the preceding frame if the preceding frame was processed under the V mode. For each harmonic, the initial phase is set equal to the actual harmonic phase of the preceding frame if the preceding frame was processed under the T mode. The actual harmonic phase of the preceding frame may be derived by taking a DFT of the past decoded residue using the entire preceding frame. Alternatively, the actual harmonic phase of the preceding frame may be derived by taking a DFT of the past decoded frame in a pitch-synchronous manner by processing various pitch periods of the preceding frame.

Thus, a novel closed-loop, multimode, mixed-domain linear prediction (MDLP) speech coder has been described. Those of skill in the art would understand that the various illustrative logical blocks and algorithm steps described in connection with the embodiments disclosed herein may be implemented or performed with a digital signal processor (DSP), an application specific integrated circuit (ASIC), discrete gate or transistor logic, discrete hardware components such as, e.g., registers and FIFO, a processor executing a set of firmware instructions, or any conventional programmable software module and a processor. The processor may advantageously be a microprocessor, but in the alternative, the processor may be any conventional processor, controller, microcontroller, or state machine. The software module could reside in RAM memory, flash memory, registers, or any other form of writable storage medium known in the art. Those of skill would further appreciate that the data, instructions, commands, information, signals, bits, symbols, and chips that may be referenced throughout the above description are advantageously represented by voltages, currents, electromagnetic waves, magnetic fields or particles, optical fields or particles, or any combination thereof.

Preferred embodiments of the present invention have thus been shown and described. It would be apparent to one of ordinary skill in the art, however, that numerous alterations may be made to the embodiments herein disclosed without departing from the spirit or scope of the invention. Therefore, the present invention is not to be limited except in accordance with the following claims.

What is claimed is:

1. A multimode, mixed-domain, speech processor, comprising:

a coder having at least one time-domain coding mode and at least one frequency-domain coding mode, wherein the at least one frequency-domain coding mode represents the short-term spectrum of each frame with a plurality of sinusoids having a set of parameters including frequencies, phases, and amplitudes, the phases being modeled with a polynomial representation and an initial phase value, and wherein the initial phase value is either (1) the final estimated phase value of the preceding frame if the preceding frame was coded with the at least one frequency-domain coding mode, or (2) a phase value derived from the short-term spectrum of the preceding frame if the preceding frame was coded with the at least one time-domain coding mode; and a closed-loop mode-selection device coupled to the coder and configured to select a coding mode for the coder based upon contents of frames processed by the speech processor.

2. The speech processor of claim 1, wherein the sinusoid frequencies for each frame are integer multiples of the pitch frequency of the frame.

3. The speech processor of claim 1, wherein the sinusoid frequencies for each frame are taken from a set of real numbers between 0 and $2\pi$.

4. A method of processing frames, comprising:

applying an open-loop coding mode selection process to each successive input frame to select either a time-domain coding mode or a frequency-domain coding mode based upon speech content of the input frame;

frequency-domain coding the input frame if the speech content of the input frame indicates steady state voiced speech, wherein the step of frequency-domain coding comprises representing the short-term spectrum of each frame with a plurality of sinusoids having a set of parameters including frequencies, phases, and amplitudes, the phases being modeled with a polynomial representation and an initial phase value, and wherein the initial phase value is either (1) the final estimated phase value of the preceding frame if the preceding frame was frequency-domain-coded, or (2) a phase value derived from the short-term spectrum of the preceding frame if the preceding frame was time-domain-coded;

time-domain coding the input frame if the speech content of the input frame indicates anything other than steady state voiced speech;

comparing the frequency-domain-coded frame with the input frame to obtain a performance measure; and time-domain coding the input frame if the performance measure falls below a predefined threshold value.

5. The method of claim 4, wherein the sinusoid frequencies for each frame are integer multiples of the pitch frequency of the frame.

6. The method of claim 4, wherein the sinusoid frequencies for each frame are taken from a set of real numbers between 0 and $2\pi$.

7. A multimode, mixed-domain, speech processor, comprising:

means for applying an open-loop coding mode selection process to an input frame to select either a time-domain coding mode or a frequency-domain coding mode based upon speech content of the input frame;

means for frequency-domain coding the input frame if the speech content of the input frame indicates steady state voiced speech, wherein the means for frequency-domain coding comprises means for representing the short-term spectrum of each frame with a plurality of sinusoids having a set of parameters including frequencies, phases, and amplitudes, the phases being modeled with a polynomial representation and an initial phase value, and wherein the initial phase value is either (1) the final estimated phase value of an immediately preceding frame if the immediately preceding frame was frequency-domain-coded, or (2) a phase value derived from the short-term spectrum of the immediately preceding frame if the immediately preceding frame was time-domain-coded;

means for time-domain coding the input frame if the speech content of the input frame indicates anything other than steady state voiced speech;

means for comparing the frequency-domain-coded frame with the input frame to obtain a performance measure; and means for time-domain coding the input frame if the performance measure falls below a predefined threshold value.

8. The speech processor of claim 7, wherein the sinusoid frequencies for each frame are integer multiples of the pitch frequency of the frame.

9. The speech processor of claim 7, wherein the sinusoid frequencies for each frame are taken from a set of real numbers between 0 and $2\pi$.

* * * * *